US006401799B1

(12) United States Patent
Arai et al.

(10) Patent No.: US 6,401,799 B1
(45) Date of Patent: Jun. 11, 2002

(54) METHOD OF MANUFACTURING MAGNET MATERIAL, RIBBON-SHAPED MAGNET MATERIAL, MAGNETIC POWDER AND BONDED MAGNET

(75) Inventors: Akira Arai, Shimosuwa-machi; Hiroshi Kato, Okaya, both of (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 09/636,423

(22) Filed: Aug. 10, 2000

(30) Foreign Application Priority Data

Aug. 11, 1999 (JP) ..... 11-227461

(51) Int. Cl.[7] ..... B22D 11/06; B22D 11/00
(52) U.S. Cl. ..... 164/463; 164/423
(58) Field of Search ..... 164/463, 423

(56) References Cited

FOREIGN PATENT DOCUMENTS

| | | |
|---|---|---|
| EP | 0 529 148 A2 | 3/1993 |
| JP | 103171110 | 1/1998 |

OTHER PUBLICATIONS

Dipl.–Ing. Eckart Hoffman, Patentanwalt, European Search Report, Jun. 26, 2001 (3 pages).

*Primary Examiner*—Kuang Y. Lin
(74) *Attorney, Agent, or Firm*—Harness, Dickey & Pierce, P.L.C.

(57) ABSTRACT

A magnet material having excellent magnetic properties and a bonded magnet formed of the magnet material as well as a method of manufacturing the magnet material are disclosed. The method of manufacturing the magnet material is carried out by discharging a molten metal of the magnet material from a nozzle while rotating a cooling roll having a surface layer composed of ceramics on its outer periphery to be collided with the surface layer of the cooling roll and solidified by cooling, the method of manufacturing the magnet material being characterized in that the time during which the magnet material is in contact with the surface layer of the cooling roll is not less than 0.5 ms when the molten metal of said magnet material is discharged from directly above the center of rotation of the cooling roll toward an apex part of the cooling roll to be collided with the apex part.

7 Claims, 4 Drawing Sheets

METHOD OF MANUFACTURING MAGNET MATERIAL, RIBBON-SHAPED MAGNET MATERIAL, MAGNETIC POWDER AND BONDED MAGNET

BACKGROUND OF THE INVENTION

1. Field of the Invention

This invention relates to a method of manufacturing magnet material, a ribbon-shaped magnet material, magnetic powder and a bonded magnet.

2. Description of the Prior Art

Bonded magnets formed by binding magnetic powder with a binding resin are used for motors and various kinds of actuators because of the advantages that they have a wide versatility on their shapes.

A magnet material composing a bonded magnet is manufactured, for example, by a quenching method employing a melt spinning apparatus. When the melt spinning apparatus is equipped with a single cooling roll, the method is referred to as a single roll method.

In the single roll method, a magnet material with prescribed alloy composition is melted by heating, the molten metal is jetted from a nozzle, to be collided with the peripheral surface of the cooling roll rotating with respect to the nozzle, and solidified by quenching through contact with the peripheral surface to form in a continuous manner a ribbon-shaped magnet material, namely, a melt spun ribbon (quenched ribbon). The melt spun ribbon is milled into magnetic powder, and a bonded magnet is manufactured using the magnetic powder.

The cooling roll used in the single roll method is generally formed of a copper alloy, an iron alloy or the like. Moreover, for the purpose of improving the durability, a metallic or alloy surface layer, such as of chromium plating, may be provided on the peripheral surface of the cooling roll.

However, the peripheral surface of the cooling roll is usually formed of a metal having high heat conductivity, so that the difference in the microstructure (difference in the crystal grain diameter) between the roll contact surface (surface making contact with the peripheral surface of the cooling roll) and the free surface (surface opposite to the roll contact surface) of the obtained melt spun ribbon is large due to the difference in the cooling rate. Because of this, when magnetic powder is obtained by milling the ribbon, their magnetic properties are dispersed from one magnetic powder to another, and hence the bonded magnets manufactured by using these magnetic powders do not have satisfactory magnetic properties.

SUMMARY OF THE INVENTION

Accordingly, it is an object of the present invention to provide a method of manufacturing a magnet material, a ribbon-shaped magnet material, magnetic powder and a bonded magnet that make it possible to produce a magnet with excellent magnetic properties and high reliability.

In order to achieve the object, the present invention is directed to a method of manufacturing a ribbon-shaped magnet material. The ribbon-shaped magnet material is manufactured by discharging a molten metal of the magnet material from a nozzle while rotating a cooling roll having a surface layer composed of ceramics on its outer periphery to be collided with said surface layer of said cooling roll and solidified by cooling. This method is characterized in that the time during which the magnet material is in contact with said surface layer of said cooling roll is not less than 0.5 ms when the molten metal of said magnet material is discharged from directly above the center of rotation of said cooling roll toward an apex part of said cooling roll to be collided with the apex part.

According to the manufacturing method described above, it becomes possible to manufacture a magnet material having excellent magnetic properties and excellent heat resistance and corrosion resistance.

In the present invention, it is preferred that the thickness of said surface layer is in the range of 0.5 to 50 $\mu$m. This makes it possible to reduce the difference in the crystal grain diameter between the contact surface side of the ribbon-shaped material which is in contact with the surface layer which is the peripheral surface of the cooling roll (roll contact surface side) and the opposite surface side of the ribbon-shaped material which is opposite to the roll contact surface side (the free surface side), thereby enabling to provide a magnet material especially having excellent magnetic properties.

Further, it is also preferred that the radius of said cooling roll is in the range of 50 to 500 mm. This makes it possible to provide a magnet material having high magnetic properties without enlarging the size of the spinning apparatus.

Furthermore, it is also preferred that said cooling roll is rotated at a peripheral velocity in the range of 5 to 60 m/s. This makes it possible to fine the grain diameter appropriately, thereby enabling to provide a magnet material having excellent magnetic properties.

Moreover, it is also preferred that the surface roughness Ra of said surface layer is in the range of 0.03 to 8 $\mu$m. This makes it possible to improve contacting ability of the molten metal with respect to the surface layer of the cooling roll, thereby enabling to provide a magnetic material having excellent magnetic properties.

Moreover, it is also preferred that the thickness of the ribbon-shaped magnet material obtained is in the range of 10 to 50 $\mu$m. The ribbon-shaped magnet material having the above thickness has less dispersion in its magnetic properties, so that it is possible to manufacture a magnet material having more excellent magnetic properties.

Moreover, it is also preferred that said magnet material is an alloy including rare-earth elements, transition metals and boron. This also makes it possible to provide a magnet material having excellent magnetic properties.

Another aspect of the present invention is directed to a ribbon-shaped magnet material. This ribbon-shaped material is manufactured by discharging a molten metal of the magnet material from a nozzle while rotating a cooling roll having a surface layer composed of ceramics on its outer periphery to be collided with said surface layer of said cooling roll and solidified by cooling, and the ribbon-shaped magnet material is characterized in that the time during which the magnet material is in contact with said surface layer of said cooling roll is not less than 0.5 ms when the molten metal of said magnet material is discharged from directly above the center of rotation of said cooling roll toward an apex part of said cooling roll to be collided with the apex part.

According to the invention as described above, it becomes possible to provide a ribbon-shaped magnet material from which a magnet having excellent magnetic properties and excellent heat resistance and corrosion resistance can be manufactured.

In this case, it is preferred that the thickness of said ribbon-shaped magnet material is in the range of 10 to 50

μm. The ribbon-shaped magnet material having the above thickness has less dispersion in its magnetic properties, so that it is possible to manufacture a magnet material having more excellent magnetic properties.

It is also preferred that said magnet material is an alloy including rare-earth elements, transition metals and boron. This improves the magnetic properties further.

The other aspect of the present invention is directed to magnetic powder manufactured by milling a ribbon-shaped magnet material. The ribbon-shaped magnet material is obtained by discharging a molten metal of the magnet material from a nozzle while rotating a cooling roll having a surface layer composed of ceramics on its outer periphery to be collided with said surface layer of said cooling roll and solidified by cooling. The magnetic powder is characterized in that the time during which the magnet material is in contact with said surface layer of said cooling roll is not less than 0.5 ms when the molten metal of said magnet material is discharged from directly above the center of rotation of said cooling roll toward an apex part of said cooling roll to be collided with the apex part.

According to the invention as described above, it becomes possible to provide magnetic powder from which a magnet having excellent magnetic properties and excellent heat resistance and corrosion resistance can be manufactured.

In this case, it is preferred that said magnetic powder is an alloy including rare-earth elements, transition metals and boron. This improves the magnetic properties further.

Further, it is preferred that the magnetic powder was subjected to at least one heat treatment during its manufacturing process or after the manufacturing thereof. This makes it possible to homogenize the structure and remove the effect of stress introduced by the milling process, thereby enabling to further improve the magnetic properties.

Furthermore, it is also preferred that the said magnetic powder has a single phase structure or a nano-composite structure of which mean crystal grain diameter is equal to or less than 500 nm. This also improves the magnetic properties, in particular coercive force and rectangularity in the hysteresis curve.

Moreover, it is also preferred that the mean grain size of the magnetic powder is in the range of 0.5 to 150 μm. This makes it possible to enhance the magnetic properties further.

Other aspect of the present invention is directed to a bonded magnet manufactured by bonding magnet powder with a binder, in which the magnet powder is obtained by milling a ribbon-shaped magnet material which is manufactured by discharging a molten metal of the magnet material from a nozzle while rotating a cooling roll having a surface layer composed of ceramics on its outer periphery to be collided with said surface layer of said cooling roll and solidified by cooling. The bonded magnet is characterized in that the time during which the magnet material is in contact with said surface layer of said cooling roll is not less than 0.5 ms when the molten metal of said magnet material is discharged from directly above the center of rotation of said cooling roll toward an apex part of said cooling roll to be collided with the apex part.

According to the invention as described above, it becomes possible to provide a bonded magnet having excellent magnetic properties and excellent heat resistance and corrosion resistance.

In this case, it is preferred that said magnetic powder is an alloy including rare-earth elements, transition metals and boron. This improves the magnetic properties further.

Further, it is also preferred that the content of the magnetic powder in the bonded magnet is in the range of 75 to 99.5 wt %. This makes it possible to possess high magnetic properties and high formability at manufacturing.

Furthermore, it is preferred that the coercive force $H_{cj}$ of the bonded magnet is in the range of 320 to 900 kA/m. This makes it possible to perform excellent magnetization even when a sufficient magnetizing field can not be obtained, so that a sufficient magnetic flux can be obtained.

Moreover, it is also preferred that the maximum magnetic energy product $(BH)_{max}$ of the bonded magnet is equal to or greater than 60 kJ/m$^3$. This makes it possible to obtain a magnet having high magnetic properties, and therefore if such a magnet is used for motors, high performance motors having high torque can be obtained.

The above described and other objects, structures and results of the present invention will be apparent when the following description of the preferred embodiment are considered taken in conjunction with the appended drawings.

DETAILED DESCRIPTION OF THE PREFERRED EMBODIMENTS

Figure 1:
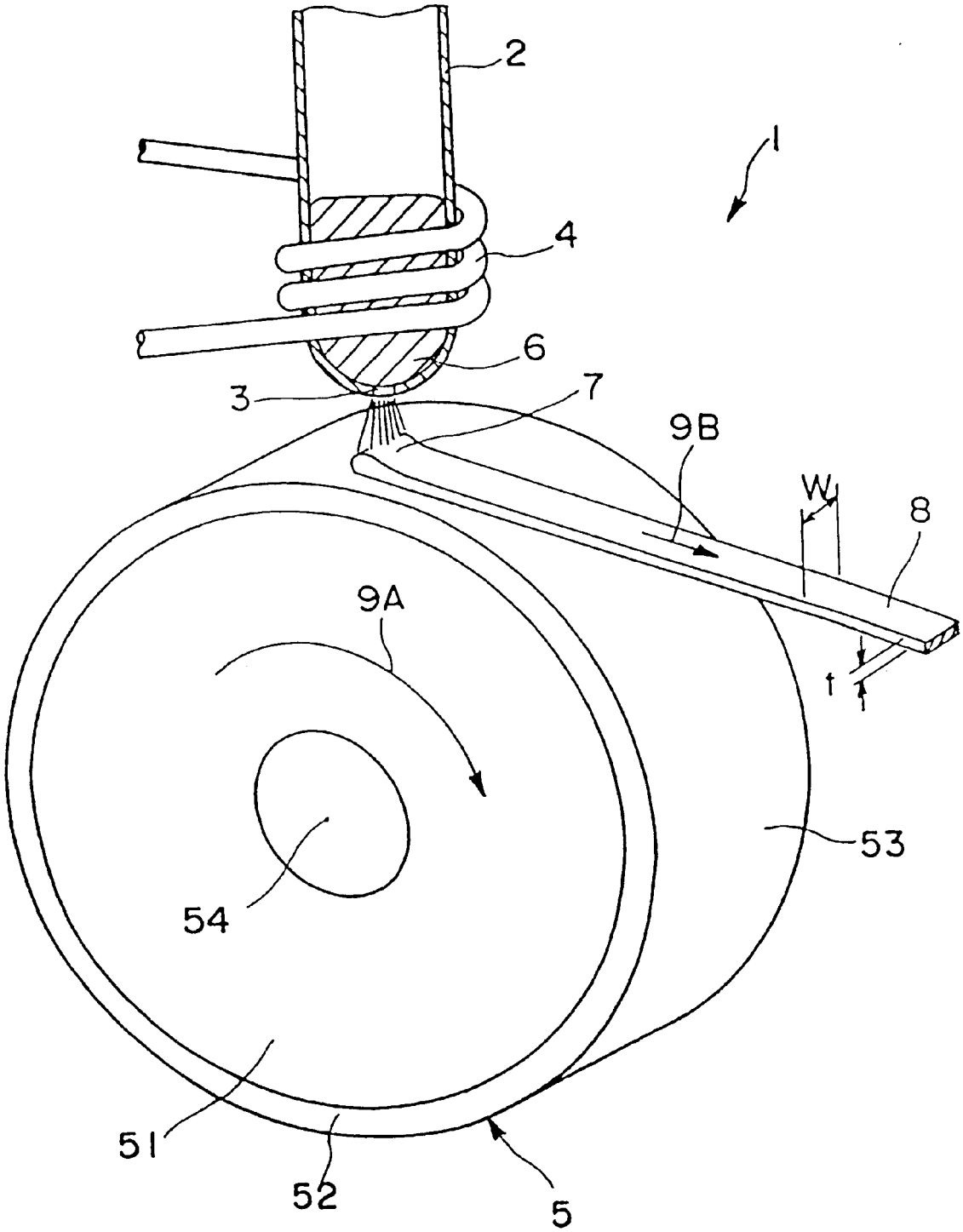
FIG. 1 is a perspective view which shows a structure of a melt spinning apparatus which is used for manufacturing a ribbon-shaped magnet material according to the present invention.

Hereinbelow, a detailed description will be made with regard to the embodiments of a method of manufacturing a magnet material, a ribbon-shaped magnet material, magnetic powder and a bonded magnet according to the present invention.

Alloy Composition of the Magnet Material

First, the alloy composition of the magnet material will be described.

In the present invention, it is preferred that the ribbon-shaped magnet material and the magnetic powder have excellent magnetic properties. Examples of such material and powder include alloys containing R (R is at least one kind selected from among rare-earth elements including Y) and alloys containing R, TM (TM is at least one kind of transition metal) and B (boron). Practically, alloys having one of the following compositions (1)–(4) are preferably used.

(1) Alloys containing rare-earth elements, principally Sm, and transition metals, principally Co, as the basic components thereof (hereinafter, referred to as "Sm—Co based alloys").

(2) Alloys containing R, transition metals, principally Fe, and B as the basic components (hereinafter, referred to as "R—TM—B based alloys").

(3) Alloys containing rare-earth elements, principally Sm, transition metals, principally Fe, and interstitial elements, principally N, as the basic components (hereinafter, referred to as "Sm—Fe—N based alloys").

(4) Alloys having composite structure (in particular, nanocomposite structure) containing R, and transition metals, principally Fe, as the basic components, and having a soft magnetic phase and a hard magnetic phase adjacent with each other.

Representative examples of the Sm—Co based alloys include $SmCo_5$ and $Sm_2TM_{17}$ (here, TM is transition metal).

Representative examples of the R—TM—B based alloys include Nd—Fe—B based alloys, Pr—Fe—B based alloys, Nd—Pr—Fe—B based alloys, Nd—Dy—Fe—B based alloys, Ce—Nd—Fe—B based alloys, Ce—Pr—Nd—Fe—B based alloys, and alloys mentioned in the above in which a part of Fe is replaced by other transition metals such as Co and Ni.

Representative examples of the Sm—Fe—N based alloys include $Sm_2Fe_{17}N_3$ obtained by nitriding the $Sm_2Fe_{17}$ alloys and Sm—Zr—Fe—Co—N based alloys that have $TbCu_7$ phase as the principal phase.

Examples of the rare-earth elements mentioned above include Y, La, Ce, Pr, Nd, Pm, Sm, Eu, Gd, Tb, Dy, Ho, Er, Tm, Yb, Lu, and misch metals. Of course, one kind or two or more kinds of these may be contained. Moreover, examples of the transition metals mentioned above include Fe, Co, Ni and the like, and one kind or two or more kinds of these may be contained.

Furthermore, for the purpose of improving the magnetic properties such as coercive force and magnetic energy product, or for the purpose of improving the heat resistance and corrosion resistance, Al, Cu, Ga, Si, Ti, V, Ta, Zr, Nb, Mo, Hf, Ag, Zn, P, Ge and the like may be included in the magnet material as needed.

The composite structure (nanocomposite structure) possesses a soft magnetic phase and a hard magnetic phase, and the thickness and the grain diameter of each phase are existed on the nanometer level (for example, 1 to 100 nm). The soft magnetic phase and the hard magnetic phase are situated adjacent with each other, and they perform magnetic exchange interaction.

The magnetization of the soft magnetic phase readily changes its orientation by the action of an external magnetic field. Therefore, when the soft magnetic phase coexists with the hard magnetic phase, the magnetization curve for the entire system shows a stepped "serpentine curve" in the second quadrant of the B-H diagram (J-H diagram). However, when the soft magnetic phase has a sufficiently small size of less than several tens of nm, magnetization of the soft magnetic body is sufficiently strongly constrained through the coupling with the magnetization of the surrounding hard magnetic bodies, so that the entire system exhibits functions like a hard magnetic body.

A magnet having such a composite structure (nanocomposite structure) has mainly the following five features (1) to (5).

(1) In the second quadrant of the B-H diagram (J-H diagram) (that is, coordinate where the longitudinal axis represents magnetization (J) and the horizontal axis represents magnetic field (H)), the magnetization springs back reversively (in this sense, such a magnet is also referred to as a "spring magnet").

(2) It has a satisfactory magnetizability, and it can be magnetized with a relatively low magnetic field.

(3) The temperature dependence of the magnetic properties are small as compared with the case where the system is constituted from a hard magnetic phase alone.

(4) The changes in the magnetic properties with the lapse of time are small.

(5) No deterioration in the magnetic properties is observable even if it is finely milled.

In the R—TM—B based alloy (TM is Fe, or Fe and Co) described above, the hard magnetic phase and the soft magnetic phase are composed of, for example, respectively by the following.

The hard magnetic phase: $R_2TM_{14}B$ system (where, TM is Fe or, Fe and Co), or $R_2TM_{14}BQ$ system.

The soft magnetic phase: TM ($\alpha$-Fe or $\alpha$-(Fe, Co) in particular), or an alloy phase of TM and Q.

In this connection, it is to be noted that the metal composition and the structure of the composite of the magnet material is not limited to those described above.

Production of Ribbon-shaped Magnet Material

Hereinbelow, a description will be made with regard to the method of manufacturing the magnet material and the ribbon-shaped magnet material according to the present invention.

In this invention, a ribbon-shaped magnet material (referred to as "melt spun ribbon") is formed by quenching a molten magnet material (alloy) and then solidifying it. The following is one example of the manufacturing method.

Figure 2:
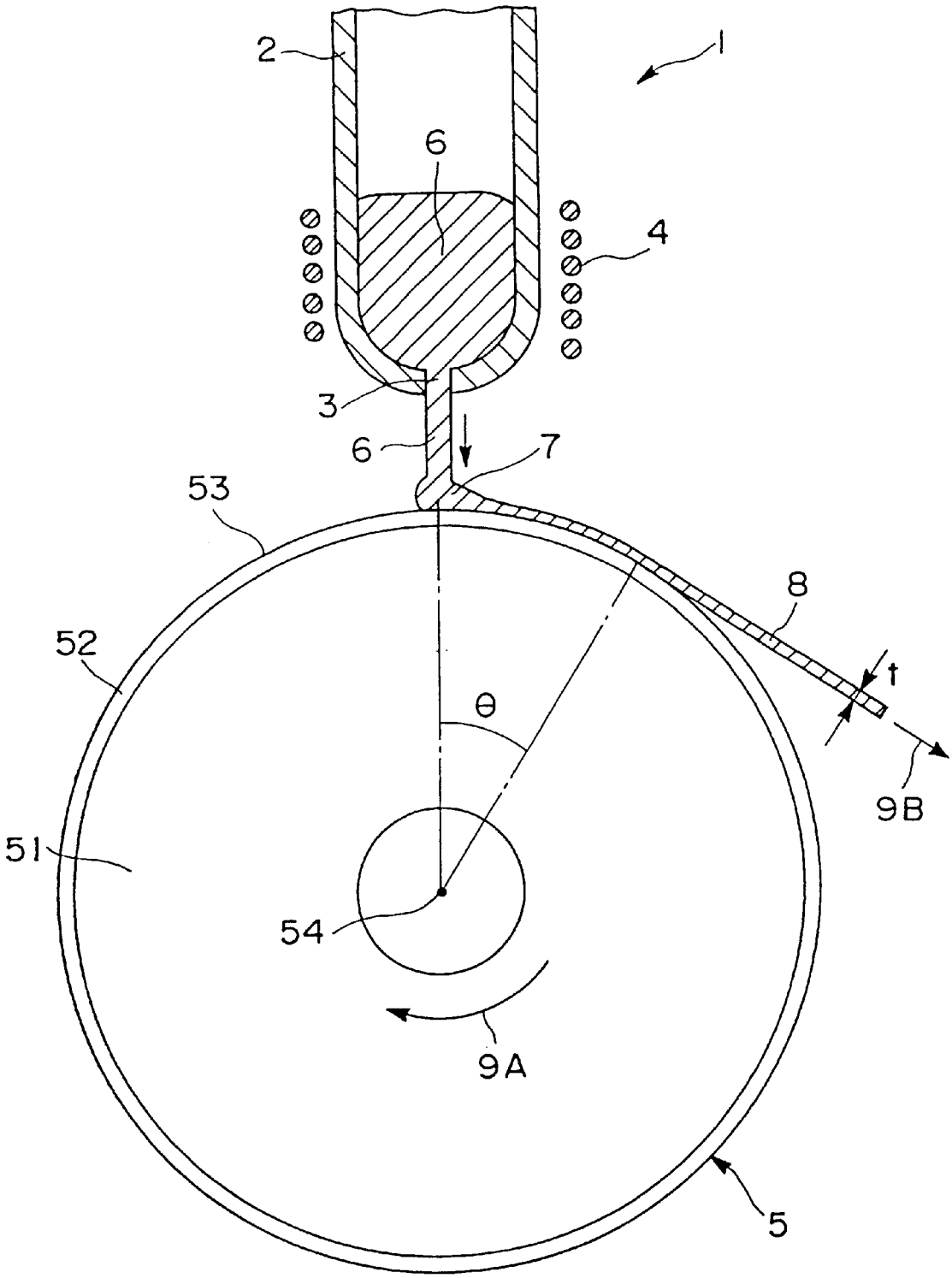
FIG. 2 is a side view which shows a positional relationship between a cooling roll and a nozzle of the apparatus shown in FIG. 1.
Figure 3:
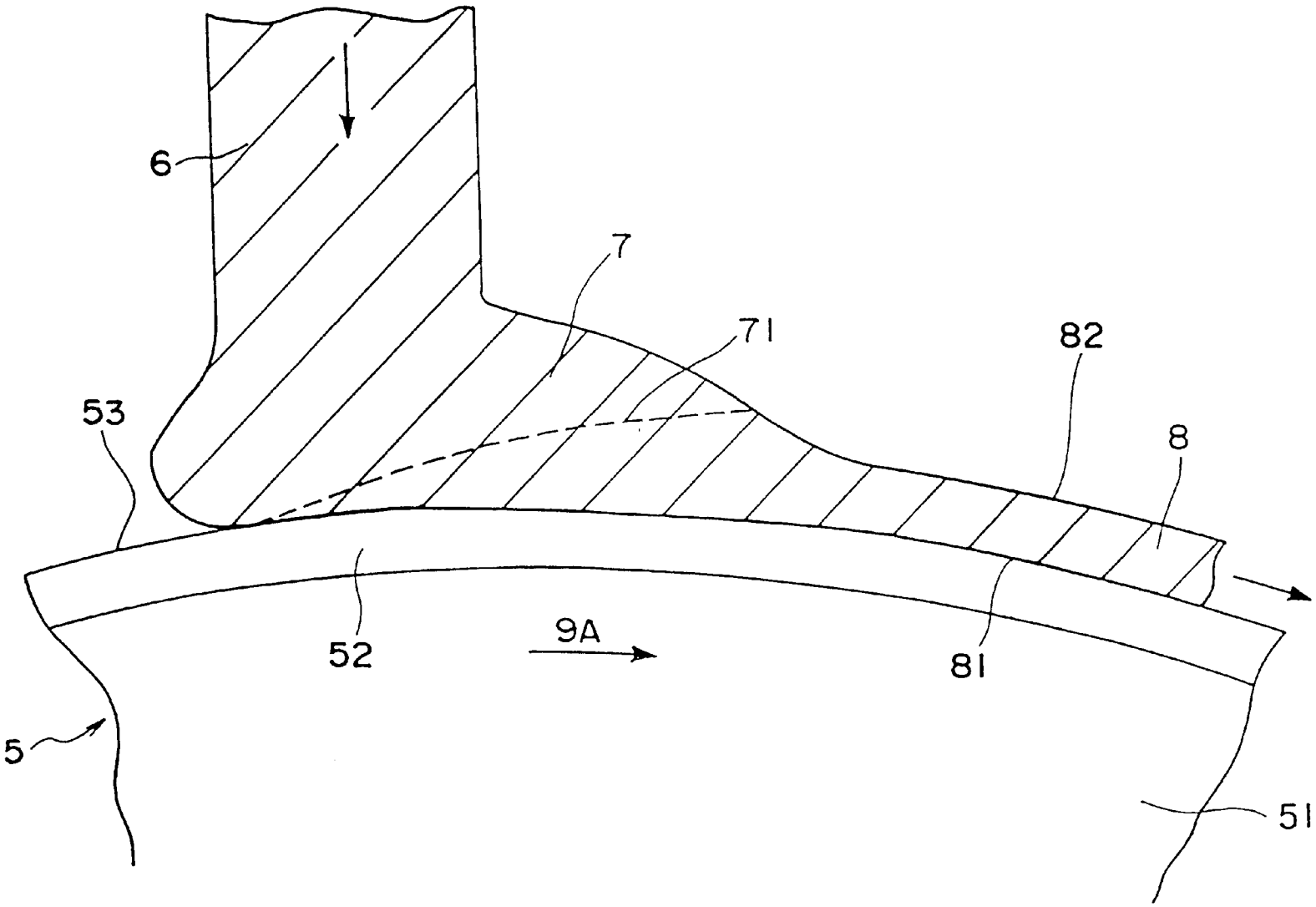
FIG. 3 is a sectional side view showing the situation in the vicinity of colliding section of the molten metal with the cooling roll in the apparatus shown in FIG. 1.

FIG. 1 is a perspective view showing an example of the configuration of an apparatus (melt spinning apparatus) for manufacturing a magnet material by the quenching method using a single roll, FIG. 2 is a side view of a cooling roll of the apparatus shown in FIG. 1, and FIG. 3 is a sectional side view showing the situation in the vicinity of colliding section of the molten metal with the cooling roll in the apparatus shown in FIG. 1.

As shown in FIG. 1, the melt spinning apparatus 1 is provided with a cylindrical body 2 capable of storing the magnet material, and a cooling roll 5 which rotates in the direction of an arrow 9A in the figure relative to the cylindrical body 2. A nozzle (orifice) 3 which injects the molten metal of the magnet material alloy is formed at the lower end of the cylindrical body 2.

In this connection, the cylindrical body 2 may be formed of quartz or heat resistant ceramics such as alumina and magnesia. Further, the orifice of the nozzle 3 may be formed into a circular shape, elliptical shape or slit shape.

Further, a heating coil 4 is arranged on the outer periphery of the cylindrical body 2 in the vicinity of the nozzle 3, and the magnet material in the cylindrical body 2 is melted by inductively heating the interior of the cylindrical body 2 through application of, for example, a high frequency wave to the coil 4.

In this case, for example, a carbon heater can be used as the heating means instead of the coil 4 described above.

The cooling roll 5 is constructed from a base part 51 and a surface layer 52 which forms a circumferential surface 53 of the cooling roll 5.

In this connection, it is preferred that the base part 51 is formed of a metallic material having high heat conductivity such as copper or a copper alloy. Further, the surface layer 52 is formed of ceramics. With this arrangement, the heat conductivity of the surface layer 52 can be made to be lower than that of the base layer 51.

Examples of the ceramics for composing the surface layer 52 include oxide ceramics such as $Al_2O_3$, $SiO_2$, $TiO_2$, $Ti_2O_3$, $ZrO_2$, $Y_2O_3$, barium titanate and strontium titanate; nitride ceramics such as AlN, $Si_3N_4$, TiN and BN; carbide ceramics such as graphite, SiC, ZrC, $Al_4C_3$, $CaC_2$ and WC; and composite ceramics obtained by arbitrarily combining two or more kinds of these ceramics.

Moreover, the surface layer 52 may be not only a single layer as shown in the figure, but may be, for example, a laminate of a plurality of layers with different compositions. In the latter case, it is preferable that the adjacent layers have high adhesiveness with each other, an example of which is the case where the adjacent layers contain the identical elements.

Furthermore, even if the surface layer 52 is composed of a single layer, its composition needs not be limited to the case where it is uniform in the thickness direction, and it may be one in which the contents of the components vary successively in the thickness direction (functionally gradient material).

The following advantages can be obtained by providing the surface layer 52 composed of the ceramics as described above.

Since the peripheral surface 53 of the cooling roll 5 is formed of ceramics which has a smaller heat conductivity as compared with a metal, overcooling of the molten metal 6 for the melt spun ribbon 8 is suppressed. Moreover, by choosing ceramics as the material for the surface layer, it is possible to drastically prolong the time (hereinafter, referred to as "contact time with the peripheral surface") from collision of the molten metal 6 with the peripheral surface 53 of the cooling roll to its formation of the melt spun ribbon 8 through solidification and its separation from the peripheral surface 53, as compared with the conventional cooling roll where no surface layer is provided or provided with a chromium plated layer. In the conventional cooling roll, the contact time of the melt spun ribbon with the peripheral surface of the roll is short, so that while the roll contact surface of the melt spun ribbon 8 is overcooled, the melt spun ribbon is separated from the cooling roll before its free surface is cooled down sufficiently. As a result, the difference in the structure between the roll contact surface side and the free surface side, that is, the dispersion in the magnetic properties has been very large. In contrast, since the present invention uses the cooling roll 5 provided with the surface layer 52 formed of ceramics, the above-mentioned overcooling of the roll contact surface 81 of the melt spun ribbon 8 is suppressed and the contact time with the peripheral surface 53 can be prolonged, so that the free surface 82 can be cooled down sufficiently so as to obtain an adequate crystal grain diameter. As a result, the difference in the structure between the roll contact surface 81 side and the free surface 82 side is diminished. Consequently, the rectangularity and the coercive force in particular are improved, and in accompanying with this the maximum magnetic energy product is also enhanced, thereby exhibiting very excellent magnetic properties.

The thickness of the surface layer 52 (total thickness in the case of the laminate) may be changed depending upon the kind, composition or the like of the ceramic composing the surface layer 52, and therefore it is not limited to a particular value, but normally it is preferable that the thickness is in the range of 0.5 to 50 $\mu$m, and more preferably in the range of 1 to 20 $\mu$m. If the thickness of the surface layer 52 is too small, the cooling capability for the roll contact surface 81 of the melt spun ribbon 8 becomes high. As a result, in the case where the contact time is relatively long (described later), there arises a possibility of being unable to sufficiently reduce the difference in the crystal grain diameter between the roll contact surface 81 side and the free surface 82 side. On the other hand, if the thickness of the surface layer 52 is too large, there is a possibility of developing cracks or peeling in the surface layer 52 due to thermal shock when the number of times of use gets large. In particular, if the thickness of the surface layer 52 is extremely large, the cooling capability is reduced, so that there is shown an overall tendency of coarsening of the crystal grain diameter, which leads to the possibility that a sufficient improvement in the magnetic properties may not be achieved.

The formation method of the surface layer 52 is not particularly limited, and deposition, sputtering, thermal spraying, plating or the like may be employed.

Moreover, the surface of the surface layer 52, namely, the surface nature such as surface roughness of the peripheral surface 53 is related to its wettability to the molten metal 6. In this invention, the center line average height (surface roughness) Ra (in the unit of $\mu$m) of the peripheral surface 53 depends upon the kind, composition or the like of the ceramics composing the surface layer 52, and is not particularly limited. However, normally it is preferable that it is in the range of 0.03 to 8 $\mu$m, and more preferably in the range of 0.05 to 3 $\mu$m.

If the surface roughness Ra is too small, there is a possibility of generating a slip in a paddle 7 formed by the collision of the molten metal 6 with the peripheral surface 53. If the slip is conspicuous, contact between the peripheral surface 53 and the melt spun ribbon 8 is insufficient, crystal grains are coarsened and the magnetic properties are deteriorated. On the other hand, if Ra is too large, the gap formed between the peripheral surface 53 and the melt spun ribbon 8 becomes large. As a result, when the contact time described later is relatively small, the overall heat transfer becomes poor, so that the magnetic properties are deteriorated.

In order to obtain an appropriate surface roughness, the peripheral surface 53 may be subjected to grinding to be finished properly prior to the manufacture of the melt spun ribbon 8.

The radius of the cooling roll 5 is not particularly limited, but it is normally preferable to be in the range of 50 to 500 mm, and more preferably in the range of 75 to 250 mm.

If the radius of the cooling roll 5 is too small, the cooling capability of the cooling roll as a whole is reduced. As a result, especially in continuous production, the crystal grain diameter coarsens with the lapse of the time, and stable production of the melt spun ribbon with high magnetic properties becomes difficult. On the other hand, if the radius of the cooling roll 5 is too large, machining of the cooling roll itself tends to be poor, becoming difficult in some cases. Further, such a cooling roll results in the increase in the scale of the device.

Such a melt spinning apparatus 1 is installed in a chamber (not shown), and the apparatus is operated preferably under the condition that an inert gas or another ambient gas is filled in the chamber. In particular, in order to prevent oxidation of the melt spun ribbon, it is preferable that the ambient gas is an inert gas such as argon gas, helium gas or nitrogen gas.

The liquid surface of the molten metal 6 in the cylinder 2 is subjected to a prescribed pressure higher than the internal pressure of the chamber. The molten metal 6 is discharged from the nozzle 3 due to the pressure difference between the pressure acting on the liquid surface of the molten metal 6 within the cylinder and the pressure of the ambient gas within the chamber.

In the melt spinning apparatus 1, a magnet material with alloy composition as described above is placed in the cylinder 2, fused by heating with the coil 4, and the molten metal 6 is discharged from the nozzle 3. Then, as shown in FIG. 3, the molten metal 6 collides with the peripheral surface 53 of the cooling roll 5, and after forming a paddle 7, the molten metal is solidified by being cooled down rapidly while dragged by the peripheral surface 53 of the rotating cooling roll 5, thereby forming the melt spun ribbon 8 continuously or intermittently. The roll contact surface (surface making contact with the peripheral surface 53) 81 of the melt spun ribbon 8 formed in this manner detaches from the peripheral surface 53 at the point where the cooling roll 5 is rotated by an angle θ, for example, and proceeds (flies away) in the direction of arrow 9B , as shown in FIG. 2. In FIG. 3, the solidification interface 71 of the molten metal is indicated by a broken line.

The preferred range of the peripheral velocity of the cooling roll 5 varies depending upon the composition of the molten metal of the alloy, the constituent material (composition) of the surface layer 52, the surface nature (especially the wettability of the peripheral surface 53 to the molten metal) of the peripheral surface and the like. For the enhancement of the magnetic properties, however, it is normally preferable that it is in the range of 5 to 60 m/s, and more preferably in the range of 10 to 45 m/s.

If the peripheral velocity of the cooling roll is too slow, depending upon the volume flow (volume of the molten metal 6 discharged per unit time) of the melt spun ribbon 8 the mean thickness t of the melt spun ribbon 8 becomes large, showing increasing tendency in the crystal grain diameter. On the contrary, if the peripheral velocity of the cooling roll 5 is too high, most of the molten metal is converted into amorphous structure. In either case, sufficient enhancement in the magnetic properties cannot be attained even if a heat treatment would be carried out at a later time.

In the melt spinning apparatus 1, when the nozzle 3 is installed directly above the center of rotation 54 of the cooling roll 5, and the molten metal 6 is discharged (vertically) from the nozzle 3 toward the apex of the cooling roll 5 to be collided with it, as shown in FIG. 2, the time over which the magnet material is kept in contact with the peripheral surface 53 (surface of the surface layer 52 ) of the cooling roll 5, that is, the contact time with the peripheral surface mentioned above, is preferably not less than 0.5 ms, preferably in the range of 0.5 to 100 ms, and more preferably in the range of 2 to 30 ms. The reason why the contact time with the peripheral surface 53 can be made relatively long in this way, is resulted from the structure that the surface layer 52 forming the peripheral surface 53 is constructed by the use of a ceramics as has already been mentioned.

If the contact time with the peripheral surface 53 is less than 0.5 ms, the melt spun ribbon 8 is separated from the peripheral surface 53 while the cooling on the free surface 82 side of the melt spun ribbon 8 is still insufficient. As a result, the size of crystal grains on the free surface 82 side becomes large, so that sufficient magnetic properties cannot be obtained even if a heat treatment is given later on.

Moreover, although the contact time with the peripheral surface 53 may be made sufficiently long, if it is too long, adhesion between the melt spun ribbon 8 and the peripheral surface 53 is increased. As a result, depending upon the constituent material and the surface nature of the surface layer 52, there is a case that the magnet material is not completely peeled off from the peripheral surface 53, leaving a part thereof on the peripheral surface 53. Accordingly, the upper limit of the contact time with the peripheral surface 53 is preferably set so as not to create such a situation.

Furthermore, in the actual manufacture of the melt spun ribbon 8, it is not always necessary to install the nozzle 3 directly above the center of rotation 54 of the cooling roll 5. For example, the melt spun ribbon 8 may be manufactured by keeping the cooling roll 5 at the same position, and installing the nozzle 3 at a position slightly shifted leftward in FIG. 2. In this case, the molten metal 6 collides obliquely at a prescribed angle with the peripheral surface 53 from the rear side in the rotational direction of the cooling roll 5, rather than colliding with the peripheral surface 53 at right angles. Then, the magnet material proceeds (flies away) in the direction of the arrow 9B passing through the apex of the cooling roll 5 so that the contact time with the peripheral surface 53 is made longer than in the case shown in FIG. 2.

The width w and the thickness t of the melt spun ribbon 8 thus produced are preferable to be uniform as much as possible. In this case, the thickness t of the melt spun ribbon 8 is preferable to be in the range of 10 to 50 $\mu$m, and more preferably in the range of 15 to 40 $\mu$m.

If the thickness t is too small, the occupation rate of the amorphous structure in increases which prevents sufficient enhancement of the magnetic properties even with a later heat treatment. Besides, if the thickness t is too small, the mechanical strength of the melt spun ribbon 8 is decreased, which prevents production of a long continuous melt spun ribbon 8 and the product tends to be flaky or powdery. As a result, cooling becomes in homogeneous so that dispersion in the magnetic properties occurs. In addition, productivity per unit time is deteriorated.

On the other hand, if the thickness t is too large, heat transfer is dominated by heat conduction within the melt spun ribbon 8 which reveals the tendency of increase in the crystal grain diameter on the free surface 82 side, so that the magnetic properties can not be sufficiently enhanced.

Thus obtain melt spun ribbon 8 may be subjected to a heat treatment for the purpose of acceleration of recrystallization of the amorphous structure, homogeneity of structure or the like. The conditions of such a heat treatment may be set, for example, to a temperature of 400 to 900° C. and a duration of 0.5 to 300 min.

In order to prevent oxidation of the powder, it is preferred that the heat treatment is carried out in a vacuum or under a reduced pressure (for example, in the range of $1\times10^{-1}$ to $1\times10^{-6}$ Torr), or in a nonoxidizing atmosphere of an inert gas such as nitrogen, argon and helium.

The melt spun ribbon (ribbon-shaped magnet material) 8 obtained in this way described above has a fine crystal structure or a structure in which a fine crystal is contained in its amorphous structure.

In the above, the quenching method is described in terms of the single roll method, but the twin roll method may also be employed. These quenching methods are particularly advantageous for improving the magnetic properties (especially, coercive force and the like) of the bonded magnet, because the microstructure (crystal grain) can be fined by these methods.

Manufacture of Magnetic Powder

Magnetic powder of the present invention is obtained by milling the melt spun ribbon 8 formed as in the above.

Method of the milling is not particularly limited, and may be done by using various kinds of milling apparatuses or crushers such as a ball mill, vibration mill, jet mill and pin mill. In this case, the milling may be carried out in a vacuum or under reduced pressure (for example, $1\times10^{-1}$ to $1\times10^{-6}$ Torr) or in an nonoxidizing atmosphere such as in nitrogen gas, argon gas or helium gas, in order to prevent oxidation.

The mean grain diameter of the magnetic powder is not particularly limited, but considering prevention of oxidation of the magnetic powder and prevention of deterioration in the magnetic properties during the milling process, when it is intended for manufacture of a bonded magnet (rare earth bonded magnet) described later, it is preferable to be in the range of 0.5 to 150 $\mu$m, and more preferably in the range of 1 to 60 $\mu$m.

Moreover, for obtaining a more satisfactory moldability at moldering of the bonded magnet, it is preferable that the grain diameter distribution of the magnetic powder possesses a certain degree of dispersion. With this arrangement, it is possible to reduce the void ratio (porosity) of the obtained bonded magnet. As a result, it is possible to enhance the density and mechanical strength of the bonded magnet in comparison with the bonded magnet having the equal content of the magnetic powder but having no or less grain diameter distribution in the magnetic powder, thereby enabling to improve the magnetic properties still further.

In order to remove the effect of stress introduced during the milling process and control crystal grain diameter, the obtained magnetic powder may be subjected to a heat treatment. The conditions for the heat treatment may be set, for example, to a temperature in the range of 350 to 850° C. and a duration of 0.5 to 300 min.

Further, in order to prevent oxidation of the powder, it is preferable to perform the heat treatment in a vacuum or under a reduced pressure (for example, in the range of $1\times10^{-1}$ to $1\times10^{-6}$ Torr), or in a nonoxidizing atmosphere of an inert gas such as nitrogen, argon and helium.

When a bonded magnet is manufactured using magnetic powder thus obtained, the magnetic powder has a high bondability with the binding resin (wettability to the binding resin), so that the produced bonded magnet has a high mechanical strength and excellent thermal stability (heat resistance) and corrosion resistance. Accordingly, it can be concluded that the magnetic powder is suitable for the manufacture of the bonded magnet and the bonded magnet has a high reliability.

In the present invention, it is preferred that the magnetic powder have mean crystal grain diameter of not more than 500 nm, more preferably to be not more than 200 nm, and more preferably to be in the range of 10 to 120 nm. This is because sufficient enhancement of the magnetic properties, in particular the coercive force and the rectangularity cannot be attained if the mean crystal grain diameter is too large.

In this case, it is to be noted that it is preferred that the mean crystal grain diameter is set to the above range regardless of whether the magnet material has a single phase structure as in the cases (1) to (3) described in the above or has a composite structure as in the case (4), and regardless of whether or not a heat treatment is applied to the melt spun ribbon 8 or the magnetic powder, or regardless of the heat treatment conditions.

Bonded Magnet and Manufacturing Method Thereof

Herein below, a description will be made with regard to a bonded magnet of the present invention and a method of manufacturing the bonded magnet.

The bonded magnet of the present invention is formed by bonding the magnetic powder as described above with a binder such as a binder resin. Thermoplastic resins and thermosetting resins can be used as the binder resin.

Examples of the thermoplastic resins include a polyamide (example: nylon 6, nylon 46, nylon 66, nylon 610, nylon 612, nylon 11, nylon 12, nylon 6-12, nylon 6-66); a thermoplastic polyimide; a liquid crystal polymer such as an aromatic polyester; a poly phenylene oxide; a poly phenylene sulfide; a polyolefin such as a polyethylene, a polypropylene and an ethylene-vinyl acetate copolymer; a modified polyolefin; a polycarbonate; a poly methyl methacrylate; a polyester such as a poly ethylen terephthalate and a poly butylene terephthalate; a polyether; a polyether ether ketone; a polyetherimide; a polyacetal; and a copolymer, a blended body and a polymer alloy having these as main ingredients. One kind or a mixture of two or more kinds of these can be employed.

Among these resins, a resin containing a polyamide as its main ingredient is particularly preferred from the viewpoint of especially excellent moldability and high mechanical strength. Further, a resin containing a liquid crystal polymer and/or a poly phenylene sulfide as its main ingredient is also preferred from the viewpoint of enhancing the heat resistance. These thermoplastic resins also have an excellent kneadability with the magnetic powder.

These thermoplastic resins provide an advantage in that a wide range of selection can be made. For example, it is possible to provide a thermoplastic resin having a good moldability or to provide a thermoplastic resin having good heat resistance and mechanical strength by appropriately selecting their kinds or by appropriate copolymerization.

On the other hand, examples of the thermosetting resins include various kinds of epoxy resins of bisphenol type, novolak type and naphthalene-based, a phenolic resin, a urea resin, a melamine resin, a polyester (or an unsaturated polyester) resin, a polyimide resin, a silicone resin, a polyurethane resin or the like. One kind or a mixture of two or more kinds of these can be employed.

Among these resins, an epoxy resin, a phenolic resin, a polyimide resin and a silicone resin are particularly preferred from the viewpoint of their special excellence in the moldability, high mechanical strength, and high heat resistance. In this case, an epoxy resin is especially preferred. These thermosetting resins also have an excellent kneadability with the magnetic powder and homogeneity in kneading.

The thermosetting resin to be used may be either in liquid state or in solid (powdery) state at room temperature under the condition that the resin has not yet been hardened (cured).

Further, the bonded magnet of the present invention may be either type of isotropic magnet or anisotropic magnet, but isotropic magnet is preferable since it can be easily manufactured.

For example, a bonded magnet according to this invention described in the above may be manufactured as follows. First, a bonded magnet composition (compound) which contains the magnetic powder, a binder resin and an additive (antioxidant, lubricant, or the like) as needed, is prepared. Then, the prepared compound is formed into a desired magnet form in a magnetic field or a space free from magnetic field by a molding method such as compression molding (press molding), extrusion molding or injection molding. When the binding resin used is a thermosetting type, the obtained green body is hardened by heating or the like after molding.

In these three molding methods, the extrusion molding and the injection molding (in particular, the injection molding) have advantages in that the latitude of shape selection is broad, the productivity is high, and the like. However, these molding methods require to ensure a sufficiently high fluidity of the compound in the molding machine in order to obtain satisfactory moldability. For this reason, in these methods it is not possible to increase the content of the magnetic powder, namely, to make the bonded magnet having high density, as compared with the case of the compression molding method. In this invention, however, it is possible to obtain a high magnetic flux density as will be described later, so that excellent magnetic properties can be obtained even without making the bonded magnet high density. This advantage of the present invention can also be extended even in the case where bonded magnets are manufactured by the extrusion molding method or the injection molding method.

The content of the magnetic powder in the bonded magnet is not particularly limited, and it is normally determined by considering the type of the molding method or obtainable moldability and high magnetic properties. More specifically, it is preferable to be in the range of 75–99.5 wt %, and more preferably in the range of 85–98 wt %.

In particular, in the case of a bonded magnet to be manufactured by the compression molding method, the content of the magnetic powder should preferably lie in the range of 90 –99.5 wt %, and more preferably lie in the range of 93–98.5 wt %.

Further, in the case of a bonded magnet to be manufactured by the extrusion molding or the injection molding, the content of the magnetic powder should preferably lie in the range of 75–98 wt %, and more preferably lie in the range of 85–97 wt %.

Further, in the present invention, it is also possible to provide a bonded magnet having elasticity (flexibility) by using a binder having elasticity. As for such a binder, various rubbers and various thermoplastic elastomers can be used. Examples of the various rubbers include olefin-based rubbers such as natural rubber (NR), polyisoprene rubber (IR), butadiene based rubber such as butadien rubber (BR, 1, 2-BR), styrene-butadiene rubber (SBR) and the like, diene-based rubber such as chloroprene rubber (CR) and acrylonitorile butadiene rubber (NBR) and the like, isobutylene-isoprene rubber (IIR), ethylene-propylene rubber (EPM, EPDM), ethylene-vinylacetate rubber (EVA), acrylic rubber (ACM, ANM), halogenated isobutylene-isoprene rubber (X-IIR); urethane based rubber such as polyester urethane rubber (AU) and polyether urethane rubber (EU); ether-based rubber such as hydrin rubber (CO, ECO, GCO, EGCO; polysulfide-based rubber such as polysulfide rubber (T); silicone rubber (Q); fluorocarbon rubber (FKM, FZ); and chlorinated polyethylene (CM). Further, examples of the thermoplastic elastomers include styrene-based elastomer, polyolefin thermoplastic elastomer; polyvinyl choride thermoplastic elastomer, thermoplastic polyurethane elastomer, polyester thermoplastic elastomer, polyamide thermoplastic elastomer, thermoplastic 1,2-polybutadiene, thermoplastic trans-polyisoprene elastomer, fluorocarbon thermoplastic elastomer, and chrolinated polyethylene elastomer, and the like.

The density ρ of the bonded magnet is determined by factors such as the specific gravity of the magnetic powder contained in the magnet, the content of the magnetic powder, the void ratio of the bonded magnet and the like. In the bonded magnets according to this invention, the density ρ is not particularly limited, but it is preferable that the density ρ is equal to or greater than 5.0 g/cm$^3$, and it is more preferable that the density ρ is in the range of 5.5–6.6 g/cm$^3$. Further, in the case of the bonded magnet having elasticity, the density ρ may not be greater than 5.0 g/cm$^3$.

In this invention, since the magnetic flux density and the coercive force of the magnetic powder are relatively high, the molded bonded magnet provides excellent magnetic properties (especially, high maximum magnetic energy product and high coercive force) even when the content of the magnetic powder is relatively low. In this regard, it goes without saying that it is possible to obtain the excellent magnetic properties in the case where the content of the magnetic powder is high.

It is preferred that the bonded magnet according to the present invention has the coercive force $H_{cJ}$ in the range of 320 to 900 kA/m, and more preferably in the range of 380 to 720 kA/m. If the coercive force is less than the stated lower limit, demagnetization under application of a reverse magnetic field is conspicuous for some types of motors, and the heat resistance at high temperatures is deteriorated. Further, if the coercive force exceeds the above-stated upper limit, the magnetizability is deteriorated. Accordingly, by setting the coercive force $H_{cJ}$ within the above-stated range, satisfactory magnetization and sufficient magnetic flux density can be realized even if a necessary magnetizing field fails to be obtained in such a case as multipolar magnetization of a bonded magnet (in particular, for a cylindrical magnet). Accordingly, it is possible to provide a high performance bonded magnet, especially a bonded magnet for motors.

Further, it is also preferred that the bonded magnet according to the present invention has the maximum magnetic energy product $(BH)_{max}$ higher than 60 kJ/m$^3$, more preferably higher than 65 kJ/m$^3$, and still more preferably to be in the range of 70 to 130 kJ/m$^3$. If the maximum magnetic energy product $(BH)_{max}$ is lower than 60 kJ/m$^3$, sufficient torque can not be obtained depending upon the kind and the structure of the motor when it is used for motors.

The shape and size of the bonded magnet according to the present invention are not particularly limited. As to the shape of the bonded magnet, all shapes can be adopted, namely, the bonded magnet can be formed into columnar, prismatic, cylindrical (ring-shaped), circular, plate-like and curved plate like shape, and the like. Further, their sizes can be any from a large size to a micro size.

EXAMPLES

Embodiment 1

A melt spun ribbon with alloy composition $Nd_{9.1}Fe_{bal}Co_{8.5}B_{5.5}Al_{0.2}$ was obtained according to the following method.

First, each of the materials Nd, Fe, Co, B and Al was weighed, and then their mixture was melted and cast in an Ar gas in a high frequency induction melting furnace to obtain a mother alloy ingot. Then, a sample of about 15 g was segmented from the ingot.

A melt spinning apparatus 1 as shown in FIG. 1 to FIG. 3 was prepared, and the sample was placed in a quartz tube 2 having a nozzle (a circular orifice having a diameter of 0.6 mm) 3 at the bottom.

As for the cooling roll 5, a roll (radius 100 mm) provided with the surface layer 52 of ZrC of a mean thickness 5 μm formed by sputtering on the outer periphery of the copper-made base part 51, was manufactured, and the peripheral surface 53 of the cooling roll was finished by surface grinding so as to have a surface roughness Ra of 0.5 μm.

After evacuating the interior of a chamber in which the melt spinning apparatus 1 is housed, an inert gas (Ar gas) was introduced to obtain an atmosphere with desired temperature and pressure.

Next, the ingot sample within the quartz tube was melted by high frequency induction heating using the coil 4. Then, after setting the peripheral velocity of the cooling roll 5 to 14 to 25 m/s, the jetting pressure (difference pressure between the inner pressure of the quartz tube and the ambient pressure) to 30 kPa, and the pressure of the ambient gas to 250 Torr, a melt spun ribbon was manufactured continuously by jetting the molten metal toward the peripheral surface around the apex of the cooling roll 5 from directly above the center of rotation of the cooling roll. The average thickness of the obtained melt spun ribbon was 19 to 33 $\mu$m.

At this time, observation by a high speed camera through a peep window provided in the chamber was performed. Then, based on the result of the observation, the length (contact length) from the collision of the molten metal with the peripheral surface to the separation of the melt spun ribbon from the peripheral surface is determined, and the contact time with the peripheral surface was calculated from the obtained contact length and the peripheral velocity of the cooling roll.

As a result, it was found that the contact time of the melt spun ribbon with the peripheral surface was 5.20 ms under the peripheral velocity of 20 m/s of the cooling roll.

Comparative Example 1

A melt spun ribbon was manufactured under the same conditions as in Embodiment 1 except for the use of a cooling roll 5 (radius of 120 mm) which was formed by providing a Cr plated layer of a mean thickness 50 $\mu$m on the outer periphery of the copper-made base part, and the surface was given a surface roughness Ra of 0.5 $\mu$m by grinding. The average thickness t of the obtained melt spun ribbon was in the range of 20 to 35 $\mu$m.

Then, the contact time of the melt spun ribbon with the peripheral surface was calculated by the same method as that in Embodiment 1. As a result, it was found that the contact time of the melt spun ribbon with the peripheral surface was 0.4 ms under the peripheral velocity of the cooling roll of 20 m/s.

As described above, it was found in this way that the contact time of the melt spun ribbon of Embodiment 1 with the peripheral surface was very large being about 13 times that of Comparative Example 1.

Moreover, when the peripheral velocity of the cooling roll was varied in Example 1 and Comparative Example 1, the contact time of the melt spun ribbon with the peripheral surface changed accordingly. However, for all peripheral velocities, the ratio of the contact time for the two cases was almost equivalent to the above value of about 13 (more precisely, 10 to 14 ).

Next, after subjecting the melt spun ribbons of Example 1 and Comparative Example 1 obtained by variously changing the peripheral velocity in a heat treatment of 680° C.×300 s in an Ar gas atmosphere, magnetic powders of various kinds were obtained by milling these melt spun ribbons. The mean grain diameter of the magnetic powders was 50 $\mu$m.

Then, the magnetic properties of each magnetic powder were measured, and the mean crystal grain diameter was examined. As for the magnetic properties, the coercive force $H_{cJ}$ and the maximum magnetic energy product $(BH)_{max}$, were measured using vibrating sample magnetometer (VSM), and the mean crystal grain diameter was measured from the result of structure observation by an electron microscope.

As a result, it was found that in the case of Example 1, the magnetic powder with the highest magnetic properties (maximum magnetic energy product) was one manufactured under the peripheral velocity of the cooling roll of 20 m/s and the contact time of 5.20 ms (mean crystal grain diameter of 40 nm). On the other hand, in the case of Comparative Example 1, the magnetic powder with the highest magnetic properties (maximum magnetic energy product) was one manufactured under the peripheral velocity of the cooling roll of 16 m/s, and the contact time of 0.49 ms (mean crystal grain diameter of 200 nm).

Compositions (compounds) for bonded magnets were prepared by mixing the respective magnetic powder with an epoxy resin and a small amount of hydrazine antioxidant and then kneading them.

Then, each of the thus obtained compounds was milled to be granular. Then, the granular substance was weighed and filled into a die of a press machine, and a molded body was obtained by compression molding (in the absence of a magnetic field) the sample at a pressure of 7 ton/cm$^2$.

After releasing from the die, the epoxy resin was cured by heating at a temperature of 175° C. (that is, subjected to cure treatment) and a ring-shaped isotropic bonded magnet with an outer diameter of 18 mm, an inner diameter of 12 mm and a height of 7 mm was obtained.

The content of the magnetic powder in each bonded magnet was 98 wt % for all. In addition, the density of each bonded magnet was about 6.2 g/cm$^3$.

For these bonded magnets, magnetic properties (coercive force $H_{cJ}$ and the maximum magnetic energy product $(BH)_{max}$) were measured at the maximum applied magnetic field of 2.0 MA/m using a DC self-recording flux meter. The temperature of the measurement was 23° C. (room temperature).

Each bonded magnet of Example 1 had a coercive force $H_{cJ}$ of 390–490 kA/m, and a maximum magnetic energy product $(BH)_{max}$ of 95–111 kJ/m$^3$.

Each bonded magnet of Comparative Example 1 had a coercive force $H_{cJ}$ of 240–360 kA/m, and a maximum magnetic energy product $(BH)_{max}$ of 51–69 kJ/m$^3$.

Figure 4:
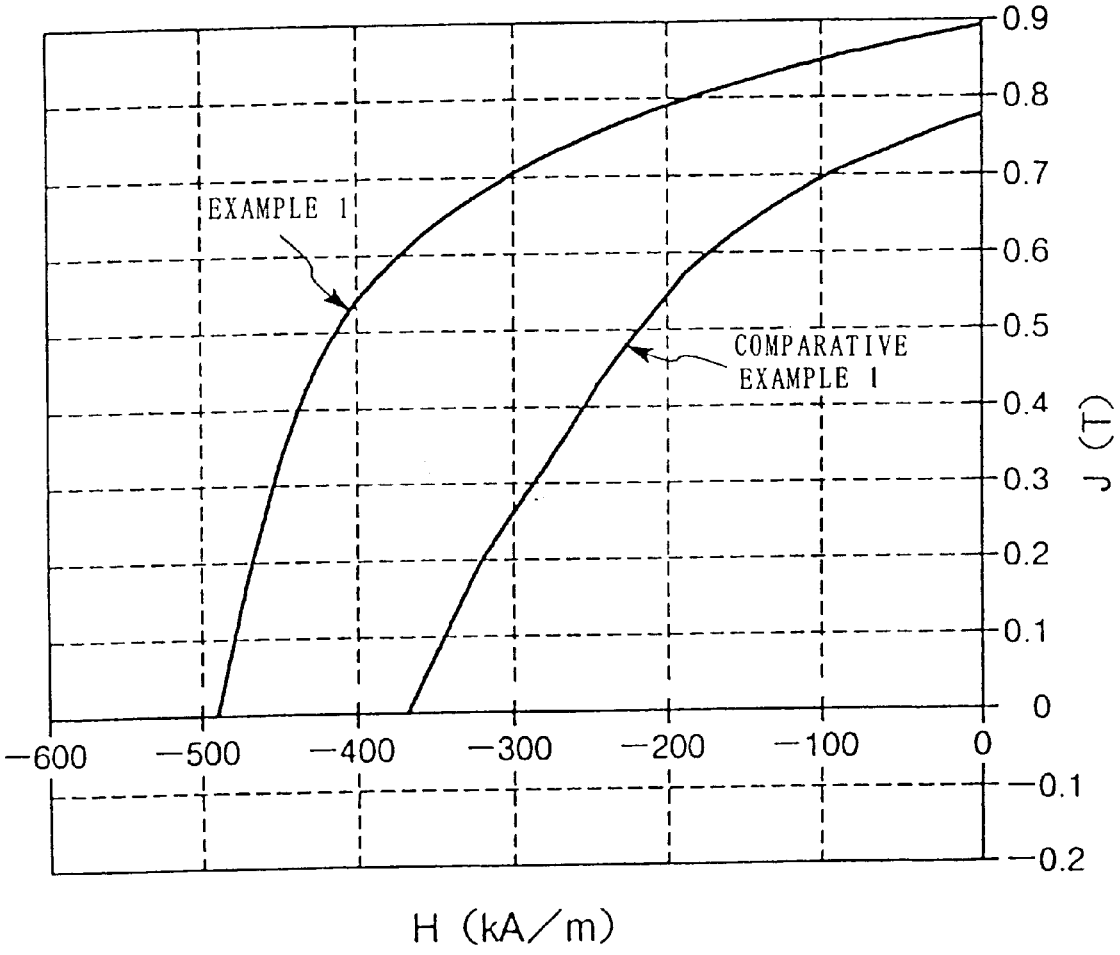
FIG. 4 is a J–H diagram (coordinate) that represents demagnetization curves of the bonded magnets of Example 1 and Comparative Example 1.

For each of Example 1 and Comparative Example 1, bonded magnet with the most excellent magnetic properties (maximum magnetic energy product) was selected, and the demagnetization curve (J-H diagram in which the ordinate is the magnetization (J) and the abscissa is the magnetic field (H)) for each was shown in FIG. 4.

As can be seen from FIG. 4, the bonded magnet by Example 1 possessed higher magnetic properties (the coercive force, the maximum magnetic energy product, and the rectangularity) compared with the bonded magnet by Comparative Example 1.

Example 2

As the cooling roll for the melt spinning apparatus 1, a cooling roll (with radius 120 mm) provided with the surface layer 52 having a constituent material, thickness, and surface roughness Ra shown in Table 1 was manufactured by sputtering on the outer periphery of the copper base part 51. The cooling rolls indicated by the sample Nos. 11 and 12 were respectively provided with laminates of two ceramic layers (layer A and layer B) with different compositions (layer A is the outermost layer and layer B is on the base part 51 side) as their surface layers 52.

By rotating these cooling rolls at a peripheral velocity of 19 m/s, melt spun ribbons with alloy composition represented by $Nd_{6.5}Pr_{1.8}Dy_{0.7}Fe_{bal.}Co_{7.8}B_{5.4}Si_{1.0}Al_{0.2}$ were manufactured in the same way as in Example 1. The mean thickness t of the obtained melt spun ribbon and the contact time (calculated in the same way as in Example 1 ) of the melt spun ribbon with the peripheral surface are also included in Table 1.

Next, after subjecting each melt spun ribbon to a heat treatment of 650° C.×10 min in an Ar gas atmosphere, magnetic powder was obtained by milling the ribbon so as to have mean grain diameter of 40 $\mu$m.

In order to analyze the phase composition of the obtained magnetic powder, X-ray diffraction test was conducted at diffraction angle 20°–60°using Cu-K$\alpha$ line. From the diffraction pattern, the presence of the peaks of $R_2(Fe.Co)_{14}B_1$ phase being a hard magnetic phase, and $\alpha$-(Fe, Co) phase being a soft magnetic phase was confirmed. In addition, from the observation result with a transmission electron microscope (TEM), it was confirmed that all of the samples Nos. 1 to 12 were forming composite structures (nanocomposite structures).

In addition, the mean crystal grain diameter was examined for each magnetic powder sample by the same method as in Example 1. The result is also included in Table 1.

Next, bonded magnets were manufactured under the same conditions as in Example 1 using these samples of the magnetic powder, and the magnetic properties (coercive force $H_{cJ}$ and maximum magnetic energy product $(BH)_{max}$) of these bonded magnets were measured. The result is also included in Table 1.

As can be seen from Table 1, all of the samples Nos. 1 to 12 of Example 2 had contact times with the peripheral surface longer than 0.5 ms and were cooled at appropriate rates, so that crystal grain diameter was generally small. As a result, excellent magnetic properties (high coercive force and large maximum magnetic energy product) were obtained.

Example 3

Bonded magnets were manufactured in the same manner as that of Examples 1 and 2 except that the bonded magnets were manufactured by extrusion molding, and then the magnetic properties thereof were measured in the same manner as that of Examples 1 and 2. In this Example, a result similar to the above was obtained.

Example 4

Bonded magnets were manufactured in the same manner as that of Examples 1 and 2 except that the bonded magnets were manufactured by injection molding, and then the magnetic properties thereof were measured in the same manner as that of Examples 1 and 2. In this Example, a result similar to the above was obtained.

Effect of the Invention

As has been described in the above, the following effects can be obtained according to this invention.

It is possible to reduce the difference in the structure, in particular the difference in the crystal grain diameter due to unequal cooling rates, on the roll contact and free sides of the obtained melt spun ribbon. As a result, magnetic materials and magnetic powder with excellent magnetic properties can be obtained, and the bonded magnets manufactured using them also have excellent magnetic properties.

In particular, by setting the constituent material, thickness, and surface roughness of the surface layer formed on the cooling roll, the radius and the peripheral velocity of the cooling roll, thickness of the melt spun ribbon, and the grain diameter (size) and the mean crystal grain diameter of the magnetic powder to preferable ranges, further excellent magnetic properties can be obtained.

Since magnetic properties comparable to or higher than those of the conventional bonded magnets can be obtained by using bonded magnets with smaller volume, it is possible to manufacture smaller motors with high performance.

Due to availability of high magnetic properties without pursuing high density in the manufacture of the bonded magnets, the dimensional precision, mechanical strength, corrosion resistance and heat resistance and the like can be enhanced along with the improvement in the moldability, so that bonded magnets with high reliability can be manufactured easily.

Moreover, due to the fact that high density is not required, the present invention is adapted to the manufacture of the bonded magnets by extrusion molding or injection molding which is difficult to achieve high density molding compared with press molding, and it is possible to obtain the effect mentioned above with the bonded magnets manufactured by the extrusion molding or injection molding. Accordingly, this invention allows to expand the selection of the molding method of the bonded magnet and thereby the versatility on the final shapes of the magnets.

Finally, it is to be noted that the present invention is not limited to the embodiments and Examples described above, and it is possible to make many changes and modifications within the sprit of the present invention, and therefore the scope of the present invention are determined only by the following claims.

TABLE 1

| No | Constituent Material of Surface Layer | Mean Thickness of Surface Layer ($\mu$m) | Surface Roughness Ra ($\mu$m) | Mean Thickness of Melt Spun Ribbon ($\mu$m) | Contact Time with Peripheral Surface (ms) | Mean Crystal Grain Diameter (nm) | $H_{al}$ (kA/m) | (BH)max (kJ/m$^3$) |
|---|---|---|---|---|---|---|---|---|
| 1 | $TiO_2$ | 11.1 | 0.3 | 23 | 4.0 | 55 | 439 | 93.1 |
| 2 | ZrC | 1.6 | 0.05 | 22 | 4.6 | 45 | 465 | 96.5 |
| 3 | WC | 3.0 | 0.2 | 23 | 5.5 | 40 | 489 | 102.3 |
| 4 | AlN | 5.2 | 0.5 | 24 | 6.5 | 35 | 511 | 108.2 |
| 5 | SiC | 8.1 | 0.1 | 25 | 7.5 | 35 | 562 | 112.0 |
| 6 | ZrC | 19.0 | 3.2 | 21 | 4.9 | 45 | 456 | 98.5 |
| 7 | AlN | 1.2 | 0.5 | 22 | 2.5 | 50 | 432 | 87.2 |
| 8 | AlN | 0.4 | 0.5 | 23 | 0.9 | 75 | 405 | 73.5 |
| 9 | WC | 48.5 | 7.5 | 26 | 2.2 | 65 | 412 | 85.2 |
| 10 | WC | 48.5 | 8.5 | 25 | 5.1 | 80 | 398 | 71.3 |

TABLE 1-continued

| No | Constituent Material of Surface Layer | Mean Thickness of Surface Layer ($\mu$m) | Surface Roughness Ra ($\mu$m) | Mean Thickness of Melt Spun Ribbon ($\mu$m) | Contact Time with Peripheral Surface (ms) | Mean Crystal Grain Diameter (nm) | $H_{a1}$ (kA/m) | (BH)max (kJ/m$^3$) |
|---|---|---|---|---|---|---|---|---|
| 11 | ZrC*/$ZrO_2$ | 7.8/3.2 | 0.08 | 27 | 5.9 | 40 | 503 | 105.9 |
| 12 | AlN*/TiN | 15.2/20.3 | 2.3 | 21 | 3.7 | 55 | 475 | 91.2 |

*On outermost layer side

What is claimed is:

1. In a method of manufacturing a ribbon-shaped magnet material by discharging a molten metal of the magnet material from a nozzle while rotating a cooling roll having a surface layer composed of ceramics on its outer periphery to be collided with said surface layer of said cooling roll and solidified by cooling, the method of manufacturing the magnet material being characterized in that the time during which the magnet material is in contact with said surface layer of said cooling roll is not less than 0.5 ms when the molten metal of said magnet material is discharged from directly above the center of rotation of said cooling roll toward an apex part of said cooling roll to be collided with the apex part.

2. The method of manufacturing a magnet material as claimed in claim 1, wherein the thickness of said surface layer is in the range of 0.5 to 50 $\mu$m.

3. The method of manufacturing a magnet material as claimed in claim 1, wherein the radius of said cooling roll is in the range of 50 to 500 mm.

4. The method of manufacturing a magnet material as claimed in claim 1, wherein said cooling roll is rotated at a peripheral velocity in the range of 5 to 60 m/s.

5. The method of manufacturing a magnet material as claimed in claim 1, wherein the surface roughness Ra of said surface layer is in the range of 0.03 to 8 $\mu$m.

6. The method of manufacturing a magnet material as claimed in claim 1, wherein the thickness of the ribbon-shaped magnet material obtained is in the range of 10 to 50 $\mu$m.

7. The method of manufacturing a magnet material as claimed in claim 1, wherein said magnet material is an alloy including rare-earth elements, transition metals and boron.

* * * * *

UNITED STATES PATENT AND TRADEMARK OFFICE

CERTIFICATE OF CORRECTION

PATENT NO. : 6,401,799 B1
DATED : June 11, 2002
INVENTOR(S) : Arai et al.

It is certified that error appears in the above-identified patent and that said Letters Patent is hereby corrected as shown below:

Column 3,
Line 46, "Other" should be -- Another --

Column 4,
Line 5, "$H_{cj}$" should be -- $H_{cJ}$ --

Column 7,
Line 7, "needs" should be -- need --

Column 10,
Line 17, delete "in"
Line 23, "in homogeneous" should be -- inhomogeneous --
Line 31, "obtain" should be -- obtained --

Column 11,
Line 57, "Here in below" should be -- Hereinbelow --

Column 13,
Line 45, "EGCO;" should be -- EGCO); --

Column 18,
Line 47, "sprit" should be -- spirit --
Line 52, "$H_{al}$" should be -- $H_{cJ}$ --

Column 20,
Line 3, "$H_{al}$" should be -- $H_{cJ}$ --

Signed and Sealed this

First Day of April, 2003

JAMES E. ROGAN
*Director of the United States Patent and Trademark Office*